US005730580A

United States Patent [19]

Japikse

[11] Patent Number: 5,730,580

[45] Date of Patent: Mar. 24, 1998

[54] TURBOMACHINES HAVING ROGUE VANES

[75] Inventor: David Japikse, Norwich, Vt.

[73] Assignee: Concepts ETI, Inc., Wilder, Vt.

[21] Appl. No.: 409,437

[22] Filed: Mar. 24, 1995

[51] Int. Cl.[6] ..... F04D 29/44

[52] U.S. Cl. ..... 415/208.3; 415/208.1

[58] Field of Search ..... 415/208.1, 208.2, 415/208.3, 208.4

[56] References Cited

U.S. PATENT DOCUMENTS

| | | | |
|---|---|---|---|
| 1,136,877 | 4/1915 | Homersham . | |
| 1,771,711 | 1/1929 | Hahn . | |
| 2,566,550 | 9/1951 | Birmann | 60/13 |
| 3,162,421 | 12/1964 | Schwarz | 253/52 |
| 3,356,289 | 12/1967 | Plotkowiak | 230/114 |
| 3,588,270 | 6/1971 | Boelcs | 415/162 |
| 3,756,739 | 9/1973 | Boussuges | 415/161 |
| 3,904,312 | 9/1975 | Exley | 415/181 |
| 3,957,392 | 5/1976 | Blackburn | 415/146 |
| 4,228,753 | 10/1980 | Davis et al. | 114/67 A |
| 4,378,194 | 3/1983 | Bandukwalla | 415/49 |
| 4,503,684 | 3/1985 | Mount et al. | 62/115 |
| 4,519,746 | 5/1985 | Wainauski et al. | 416/223 R |
| 4,657,480 | 4/1987 | Pfeil | 415/147 |
| 4,693,073 | 9/1987 | Blackburn | 60/39.02 |
| 4,770,605 | 9/1988 | Nakatomi | 415/208.3 |
| 4,877,370 | 10/1989 | Nakagawa et al. | 415/208.4 |
| 5,011,371 | 4/1991 | Gottemoller | 415/211.1 |
| 5,207,559 | 5/1993 | Clevenger et al. | 415/166 |
| 5,306,118 | 4/1994 | Holmes | 415/146 |
| 5,368,440 | 11/1994 | Japikse et al. | 415/208.3 |

*Primary Examiner*—John T. Kwon
*Attorney, Agent, or Firm*—Gerald E. Linden

[57] ABSTRACT

A turbomachine has a set of vanes in the airfoil cascade of its diffuser system. A first portion of the vanes are "rogue" vanes. A second portion of the vanes are "remaining" vanes. For a given flow through the vane set, the angle of incidence of the rogue vanes differs from the angle of incidence of the remaining normal vanes. The remaining vanes may be free-floating or positionable. The rogue vanes can be fixed or scheduled to dominate flow through the diffuser system, thereby improving efficiency of operation. Optionally, additional "intermediate" vanes can be disposed between the "rogue" vanes and the "remaining" vanes. In a centrifugal pump or compressor, the "rogue" vanes are positioned such that a preponderance of the flow will proceed through the impeller, subsequently through the rogue vanes, and then smoothly into the volute so that flow will pass smoothly through the system with minimum frictional effects and maximum pressure recovery. For centrifugal or axial turbomachines, the use of one or more sets of rogue vanes creates a "channelizing" effect of the flow throughout the entire turbomachine.

31 Claims, 10 Drawing Sheets

TURBOMACHINES HAVING ROGUE VANES

TECHNICAL FIELD OF THE INVENTION

The invention relates to turbomachines such as axial and centrifugal compressors, pumps, blowers, hydraulic turbines including hydro turbine applications and pump/turbine hybrid usage, and the like and, more particularly, to turbomachines employing principles of partial admission or emission to control (adjust) flow rate.

BACKGROUND OF THE INVENTION

As used herein, "turbomachines" includes pumps and compressors, and machines of a similar nature. Centrifugal and axial flow pumps and compressors are designed to produce a desired head, or pressure rise, at a given operating ("design") flow rate. Generally, operating a turbomachine at the design flow rate will result in the greatest efficiency. In practice, however, these machines are operated over a very wide range of flow rates, including at flow rates much higher than the design flow rate and, as particularly pertinent to the present invention, at flow rates much lower than the design flow rate.

FIG. 1 is a diagram 100 showing a generalized plot 102 of pressure rise (vertical axis) versus mass flow rate (horizontal axis). A "design point" 104 is shown, which corresponds to a particular mass flow rate "m", volumetric flow rate "Q", or flow coefficient "Φ" (where $\Phi=Q/ND_2^3$, where N is the rotational speed and $D_2$ is the impeller diameter). As illustrated, the design point 104 is not selected to produce the highest possible pressure rise, and corresponds to a particular head "h" produced by a pump or a compressor, or head coefficient "ψ" (where $\psi=h/U_2^2$, where $U_2$ is the impeller tip speed), or pressure "p". Generally, operation below the mass flow rate corresponding to the design point 104 is considered to be a "low flow regime", and operation above the mass flow rate corresponding to the design point 104 is considered to be a "high flow regime", as labelled in the diagram.

As illustrated in FIG. 1, for a given machine (i.e., compressor or pump), although operation at a mass flow rate below the design point is feasible, there is a possible stability limit, indicated on the diagram 100 by the dashed line 106, as the machine enters further into the low flow regime. At mass flow rates below the stability limit 106, the machine can be expected to cease operating efficiently, and other difficulties in the machine's operation, discussed in greater detail hereinbelow, will become evident.

Pumps, for example, are often operated to near shutoff conditions (near zero flow rate), and some compressors and blowers operating at low pressure ratio or low speed are likewise often operated at comparatively low flow rate levels. This represents the common state of affairs for compressors and pumps. However, operation at particularly low levels of flow rate is accompanied by very poor efficiency, unsteadiness yielding noise and vibration and, sometimes, reduced head. These conditions are generally acknowledged as being undesirable, and addressing same has been the object of prolonged endeavor.

Despite the broad similarity of pumps and compressors (i.e, both move fluids), in operation compressors display a few fundamental differences than pumps. Compressors can enter into a "classic" form of system surge, which is comparatively rare for pumps. System surge results from compliance in the system (e.g., the compressibility of the fluid), where energy storage becomes possible. This situation usually limits compressors from operating at lower flow rates (levels of flow) which are comparatively readily accommodated in the operation of pumps.

As the flow rate is reduced in a turbomachine, the throughflow velocity at any location within the machine is reduced. The flow field for most turbomachines is substantially axisymmetric in form, at least near the design or best efficiency operating point (see 104). This is fundamental to an understanding of the problems associated with operating a turbomachine at other than the best efficiency operating point. The velocity vector relationships at a given point in the machine (i.e., the so-called "velocity triangles") are consequently changed.

FIGS. 2A–2C are illustrative of flow into a blade row 200 (e.g., a set of rotor vanes), at various flow levels. FIG. 2A illustrates a high level of flow into three blades 202, 204 and 206 of a blade row 200. FIG. 2B illustrates a medium level of flow into the three blades 202, 204 and 206 of the blade row 200. FIG. 2C illustrates a low level of flow into three blades 202, 204 and 206 of the blade row 200. Velocity triangles 220, 222 and 224 at the inlet to the blade row are shown, for operation at these three different levels of flow, respectively, and are compiled in the chart of FIG. 2D. "W" is the relative velocity to the impeller. "U" is the impeller inlet local tip speed. Generally, an accelerating flow is shown by the arrows 208 (and vector 220) in FIG. 2A, a nearly constant flow is shown by the arrows 210 (and vector 222) in FIG. 2B, and a diffusing flow (resulting in possible stall) is shown by the arrows 212 (and vector 224) in FIG. 2C.

In the velocity triangles, the meridional component is controlled according to the equation of conservation of mass, $m=\rho Ac_m$, wherein:

m is the mass flow rate through the machine;

ρ is the density of the fluid being moved by the machine, at any particular station;

$C_m$ is the meridional velocity; and

A is the cross-sectional area perpendicular to $C_m$, such as $2\pi rb$ (where r is the radius and b is the passage height), e.g., at the rotor exit, or $\pi(\tau_{tip}^2-\tau_{hub}^2)$ for the annulus area (where $\tau_{tip}$ is the annulus tip radius, and $\tau_{hub}$ is the annulus hub radius) such as at the rotor inlet.

FIG. 2D is a diagram 250 showing a the relationship between the various inlet velocity triangles 220, 222 and 224 of FIGS. 2A–2C, respectively, to a plot 252 of pressure rise (h) versus mass flow rate (m), wherein it is apparent that the condition of FIG. 2C is (or has passed) the possible stability limit (compare 106, FIG. 1).

At a given station in the machine, the cross-sectional area is fixed and, for a pump, the density (of the fluid being moved) is also constant. For a compressor, the density can vary, but will vary only moderately at any particular cross-section. Thus, variations in density are generally second order. The primary, or first order variation, due to the change of mass flow rate, is therefore the meridional velocity.

Consequently, if the flow rate is reduced by a factor of two in a pump or in a compressor, the meridional velocity is reduced by approximately a factor of two, and the velocity triangles change as illustrated in FIGS. 2A–2D. As a result, the incidence onto the impeller blades, or incidence onto any other bladed element in the turbomachine, changes as the mass flow rate varies. For reduced flow, the incidence level increases for all blading. This has an adverse effect on operation, but is not necessarily "bad", so long as the level of incidence increase does not become too great. However, when certain levels are exceeded, the blading will begin to stall, and separated flows will have a predominant and adverse effect on the fluid mechanics of the subsequent element(s). Consequently, there are limits to "good" performance in any compressor or pump, as a function of incidence.

FIG. 3 illustrates a typical plot of efficiency "η", at a given speed, versus incidence onto the impeller (or onto other blades rows). The dashed (vertical line) 302 represents the design point (compare 104, FIG. 1). The solid line 304 represents the efficiency curve associated with normal operation. The dashed line 306 represents the possible efficiency curve associated with variable geometry or partial admission. It is clear from this figure that performance for high levels of incidence, which correspond to low levels of flow or substantially reduced flow rates, results in substantial reduction in efficiency as compared with levels possible with flow control or regulation.

The desire to control the velocity triangles within a turbomachine has long been recognized. One solution is to use variable geometry. By using variable guide vanes, variable diffusers, and other variable geometry elements, it is possible to adjust some blade angles and, hence, incidence onto the blades, for different flow rates, so as to yield better performance. However, this can be somewhat mechanically involved, and questions of component cost and mechanical reliability are introduced with such variable geometry systems. The control systems can be rather complex. In spite of these complexities, there are a number of variable geometry machines in commercial production today.

U.S. Pat. No. 3,957,392 (hereinafter referred to as "BLACKBURN"), incorporated by reference herein, discloses self-aligning vanes for a turbomachine. Generally, the outlet of a centrifugal compressor is provided with an annular row of movable diffuser vanes which align with the fluid flow direction to prevent a surge condition. Each movable diffuser vane has a pivot axis forward of the vane's center of pressure to cause the fluid from the impeller to move the vane such that the flow meets the diffuser vane leading edge with a nearly zero incident angle. The vanes are floating or freely movable on the pivot axis except for spring bias which prevents flutter. In some embodiments, the movable vanes are upstream of primary diffuser vanes, of the vane-island or of the airfoil vane type, and are movable between a closed position abutting the primary vanes to variable open positions which create auxiliary diffuser channels. BLACKBURN's techniques are principally applicable to gas turbine (aerospace) engines, or to turbochargers, which concentrate on fairly high pressure ratios and, consequently, when using centrifugal compressors, employ a passage-type of diffuser based on the historical premise that higher pressure ratio and higher efficiency, due to perceived higher pressure recoveries of the diffuser, would be obtained.

As is best viewed in FIG. 2 of BLACKBURN, corresponding to FIG. 4 herein, showing a diffuser assembly 400 (element 42 in BLACKBURN), movable vanes 448 (element 48 in BLACKBURN), having a forward pivot axis (element 50 in BLACKBURN) and generally of airfoil shape, are disposed just upstream (radially inward, as shown) of primary fixed diffuser vanes 447 (element 47 in BLACKBURN) arranged as a vane island so that the movable vanes (element 48 in BLACKBURN) are limited in their motion by abutting an inner side of the fixed primary vanes (element 47 in BLACKBURN). An impeller or compressor wheel 422 (element 22 in BLACKBURN) is driven at variable speeds, and directs a flow of air through channels (element 46 in BLACKBURN) formed by openings between adjacent primary fixed diffuser vanes (element 47 in BLACKBURN).

In BLACKBURN, surging is prevented at a particular impeller speed by using the movable (floating) vanes (element 48 in BLACKBURN) in the following manner. For normal steady flow, the floating vane (element 48 in BLACKBURN) is located in its closed position against the fixed vane (element 47 in BLACKBURN), and effectively forms a single wedge diffuser. As the tangential velocity flow component increases and the radial velocity flow component decreases, a condition is reached in which the pressure of the fluid stream against the movable vane (element 48 in BLACKBURN) moves the vane so that its leading edge continues to have a near-zero incident angle with the flow direction. The principle is similar to that of a weather vane in that by locating the pivoting axis well ahead of the vane center of pressure, the vane (element 48 in BLACKBURN) will tend to align itself with the flow direction.

As the movable vane (element 48 in BLACKBURN) moves away from the fixed vane (element 47 in BLACKBURN), there is created an auxiliary channel between the movable vane (element 48 in BLACKBURN) and the fixed vane (element 47 in BLACKBURN). This eliminates a surge condition which otherwise would be created for an equivalent fixed vane having the same tangential flow component. As the tangential component further increases, the movable vane will continue to open until reaching a possible surge condition, which corresponds to a region of impossible operation for the fixed vane. Beyond this point, an unstable surge condition will occur, and a region of impossible operation will be reached.

In other words, in BLACKBURN, the vane island diffuser design is modified by removing a small inlet section and making it a semi-freely floating vanelet in front of the full channel passage. At high flow levels, the floating inlet vanelet is pressed against the subsequent vane island segment so that it forms one continuous sector and is no longer free to move. At low flow rates, the inlet vanelet drops down from its "fixed" position and assumes its own aerodynamic position. The principal result is that the inlet portion of the diffuser system is better aligned with the flow, particularly at reduced flow rates. The stability characteristics of the stage (i.e., the diffuser system) may also be improved by employing these techniques.

An alternate approach (e.g., to BLACKBURN) to dealing with reduced flow rates for turbomachinery has been employed in certain axial turbines. The concept of partial admission is widely used for axial flow steam turbines, for rocket turbopump turbines, and for similar applications. In these cases, a turbine is required to operate at a fraction (e.g., 20% or 40%) of its design flow rate, and this operation is effected by closing off a complementary fraction (e.g., 80% or 60%, respectively) of the total annulus. This means, for example, that, for 20% flow rate, only 20% (i.e, 100% minus 80%) of the total circumferential segment is actively used to pass the flow. The remaining (closed off) 80% is "dead", and the blading passing through this section is simply "windmilling". Clearly, the effects of windmilling are not desirable, and represent a parasitic loss of power. On the other hand, the performance of the remaining 20% is so much improved (i.e., as compared with full admission turbines operated at low flow rates) that the net gain can be quite significant. The technique of partial admission turbine operation has been widely known for many decades, and is a broadly accepted part of current technology, particularly with respect to axial flow turbines. Limited weak counterparts also exist in the area of centrifugal pumps and compressors. For designs at very low flow rate, very wide rotor blades have occasionally been used, and the flow leaving the impeller is in discrete jets. These techniques can be considered to be a variation or type of partial emission from the impeller.

Another aspect of partial admission, in axial turbines, is the use of impulse blading. Impulse blading has been used in virtually all turbine applications where partial admission has been most useful. Impulse blading (approximately zero reaction) derives its effect by deflecting the flow from one angle (quite close to the tangential direction within a turbomachine) to a very similar angle but of the opposite sense as the flow leaves the blading. It is a characteristic of impulse blading that the static pressure and the magnitude of relative velocity changes very little through the blading, and the principal beneficial effect is the change in direction, without changing the magnitude of any of the kinematic or thermodynamic properties. Consequently, as the rotor blading passes through the dead regions (where flow is not passing through), the pressure will be nearly constant, and unwanted parasitic flows will not be developed except by the churning or windmilling effect of the blades passing through. In contrast thereto, most compressors use blading which is substantially reaction in nature, resulting in a significant change in pressure and velocity levels through each bladed row. Generally, a "50% reaction stage" divides its split in static pressure rise approximately equally between stator and rotor components, and the velocity levels are comparatively similar in each of these elements. The disadvantage to a reaction system when operating with partial admission is that it is likely to experience recirculating flows through the "dead" regions where the pressure difference across the rotor might force flow to pass back through the rotor, since it is not in a constant pressure regime.

The present invention is particularly useful in the context of turbomachines, such as the radial turbomachine disclosed in U.S. Pat. No. 5,368,440 (hereinafter, "CETI patent"), incorporated by reference herein. The radial turbomachine of the CETI patent has an impeller and a diffuser with a plurality of airfoil vanes. The airfoil vanes are set to have a design point angle of attack substantially equal to or less than the angle of attack corresponding to the classic onset of pressure side stall of the airfoil vane. The pressure side of the airfoil vane faces away from the rotational axis of the impeller while the suction side faces towards the impeller's rotational axis.

In addition to the aforementioned BLACKBURN and CETI patents, the following U.S. Patent references, incorporated by reference herein, are cited as providing background in the fields of centrifugal pumps and compressors, gas turbines, controls, airfoils, and the like:

- U.S. Pat. No. 1,136,877 (Homersham; 4/1915) , entitled CENTRIFUGAL BLOWER AND OTHER CENTRIFUGAL MACHINE OF A SIMILAR NATURE;
- U.S. Pat. No. 1,771,711 (Hahn; 7/1930), entitled SPLIT GUIDE BLADE FOR CENTRIFUGAL PUMPS;
- U.S. Pat. No. 2,566,550 (Birmann; 9/1951), entitled CONTROL FOR CENTRIFUGAL COMPRESSOR SYSTEMS;
- U.S. Pat. No. 3,162,421 (Schwarz; 12/1964), entitled GAS TURBINE CONSTRUCTION;
- U.S. Pat. No. 3,356,289 (Plotkowiak; 12/1967), entitled SUPERSONIC COMPRESSORS OF THE CENTRIFUGAL OR AXIAL FLOW AND CENTRIFUGAL TYPES;
- U.S. Pat. No. 3,588,270 (Boelcs; 6/1971), entitled DIFFUSER FOR A CENTRIFUGAL FLUID-FLOW TURBOMACHINE;
- U.S. Pat. No. 3,756,739 (Boussuges; 9/1973), entitled TURBINE-PUMPS;
- U.S. Pat. No. 3,904,312 (Exley; 9/1975), entitled RADIAL FLOW COMPRESSORS;
- U.S. Pat. No. 4,228,753 (Davis, et al.; 10/1980), entitled FLUIDIC CONTROLLED DIFFUSERS FOR TURBOPUMPS;
- U.S. Pat. No. 4,378,194 (Bandukwalla; 3/1983), entitled CENTRIFUGAL COMPRESSOR;
- U.S. Pat. No. 4,503,684 (Mount, et al.; 3/1985), entitled CONTROL APPARATUS FOR CENTRIFUGAL COMPRESSOR;
- U.S. Pat. No. 4,519,746 (Wainauski, et al.; 5/1985) entitled AIRFOIL BLADE;
- U.S. Pat. No. 4,657,480 (Pfeil; 4/1987), entitled VARIABLE CONTROL MECHANISM);
- U.S. Pat. No. 4,693,073 (BLACKBURN; 9/1987), entitled METHOD AND APPARATUS FOR STARTING A GAS TURBINE ENGINE;
- U.S. Pat. No. 5,011,371 (Gottemoller; 4/1991), entitled CENTRIFUGAL COMPRESSOR/PUMP WITH FLUID DYNAMICALLY VARIABLE GEOMETRY DIFFUSER;
- U.S. Pat. No. 5,207,559 (Clevenger, et al.; 5/1993) entitled VARIABLE GEOMETRY DIFFUSER ASSEMBLY; and
- U.S. Pat. No. 5,306,118 (Holmes; 4/1994), entitled MOUNTING GAS TURBINE OUTLET GUIDE VANES.

SUMMARY OF THE INVENTION

It is an object of the present invention to provide an improved turbomachine.

It is a further object of the present invention to provide a technique for improving the performance (e.g., efficiency, steadiness, noise and vibration levels, head) of a turbomachine, particularly a compressor, at relatively low flow rates.

It is a further object of the present invention to provide a technique for reducing system surge in compressors.

It is a further object of the present invention to provide a technique for controlling the velocity triangles within a turbomachine.

According to the invention, a turbomachine, such as a radial turbomachine, a centrifugal pump, or a compressor, includes a set (or row) of vanes. A selected portion of the vanes (for purposes of this discussion termed "rogue" vanes) are set at a different angle of incidence from the remaining vanes (for purposes of this discussion termed "normal" vanes) in the row to establish a channelized flow through the vane set (and, for example, through adjacent rotor blading) and to dominate flow through the vane set. In this manner, the rogue vanes control operating characteristics of the turbomachine under conditions of partial admission (or emission).

According to an aspect of the invention, the rogue vanes may be arranged in sectors, and the sectors are arranged to balance forces imposed by the vane set.

According to an aspect of the invention, the normal vanes are allowed to free-float. Alternatively, the normal vanes are scheduled (positioned according to flow), without free-floating.

In an embodiment of the invention, a portion of the vanes are rogue vanes, another portion of the vanes are normal vanes, and another portion of the vanes are "intermediate" vanes. The intermediate vanes are disposed in the row between rogue vanes and normal vanes, and the angle of incidence of the intermediate vanes is set between the angle of incidence of the rogue vanes and the angle of incidence of the normal vanes.

A useful application of the rogue vane concept disclosed herein is vanes disposed in a diffuser within a volute. Preferably, the rogue vanes are located at a position such that the preponderance of the flow will proceed through an impeller, subsequently through the rogue vanes, and then smoothly into the volute, and the rogue vanes are positioned away from a cutwater of the turbomachine.

According to the present invention, a very clear opportunity has been recognized to use the concept of partial admission (or partial emission, depending upon one's vantage point) in full or in part, for the process, by controlling the position of diffuser vanes located immediately downstream (radially outward) from a centrifugal pump or compressor impeller. By controlling several (rogue) vanes to channel or guide the flow, it is possible to conveniently induce the desired flow characteristic. These rogue vanes pass the bulk of the flow, while the other (remaining, normal) vanes are allowed to float or to be scheduled towards a closed position, according to the flow level established. Under such circumstances, the velocity triangles of the rogue vanes correspond to full load, or nearly full-load, operating conditions, rather than to the typical part-load conditions associated with partial admission.

According to the invention, there are a number of advantages to using rogue vanes to improve the overall flow state at part-load, among which are improving the velocity triangles, and therefore the improving conditions for enhanced efficiency. The use of partial admission (or emission) operation at part-load can achieve this goal, using the rogue vanes. Other advantages include having some positive effect on (i.e., reduction of) vibration and noise.

The use of rogue vanes, according to the present invention, is particularly applicable to axial compressors. An axial compressor uses a variety of stages composed of rotor (rotating or impeller bladed disks), and stators (non-rotating vane sets to re-direct the flow). Axial compressors are known to have somewhat limited stable operating range, often caused by rotating stall prior to encountering surge, or other dynamic instabilities. By using one or more rogue vanes, a section of the axial compressor can permit flow passing through according to the design conditions, with substantially reduced flow in alternate sectors. This effect can be sufficiently strong so that the classical problem of rotating stall can be substantially or totally eliminated. Under conditions of rotating stall, a dynamic instability propagates around the machine in a circumferential direction, the frequency being a fraction (e.g., 20%–60%) of the rotational speed of the rotor itself. By introducing regions of high flow rate, established by the rogue vanes, the rotating stall cannot propagate through these "barrier" regions. Thus, the use of rogue vanes will be of benefit in methods of operating industrial and aerospace gas turbines, since the serious condition of rotating stall can be eliminated, or substantially beneficially modified.

Generally, according to the present invention, a single set (row) of vanes, all disposed at a common radius from a center, includes two different types of vanes ( i.e, "rogue" and "normal."). This is markedly different from BLACKBURN, for example which, in essence, discloses two distinct sets of vanes (e.g., 48 and 47) which are disposed at two different radii from a common center.

Other objects, features and advantages of the invention will become apparent in light of the following description thereof.

BRIEF DESCRIPTION OF THE DRAWINGS

Reference is made in detail to preferred embodiments of the invention, examples of which are illustrated in the accompanying drawings. Although the invention will be described in the context of these preferred embodiments, it should be understood that it is not intended to limit the spirit and scope of the invention to these particular embodiments.

DETAILED DESCRIPTION OF THE INVENTION

The problems associated with controlling a turbomachine using principles of partial admission (or emission) have been discussed hereinabove.

According to the present invention, various embodiments of exemplary systems are disclosed, each having one or more "rogue" vanes as part of a vane set, to enhance the operating characteristics of turbomachines.

The use of rogue vanes is particularly pertinent to turbomachines intended to operate at a wide range of flow rates, including at low flow rates. Generally, in a row (set) of vanes, such as in a diffuser, the rogue vanes are set or scheduled to be open, while the remaining ("normal") vanes are closed in response to reduced flow conditions.

Figure 5A:
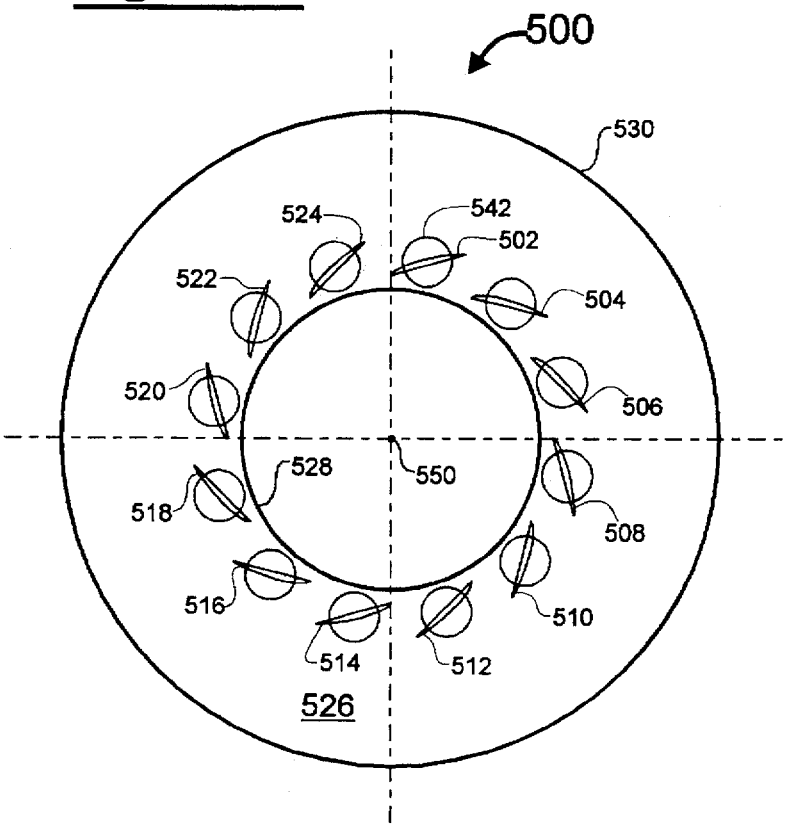
FIGS. 5A and 5B are front and side views, respectively, of a cascade diffuser system, according to the present invention.
Figure 5B:
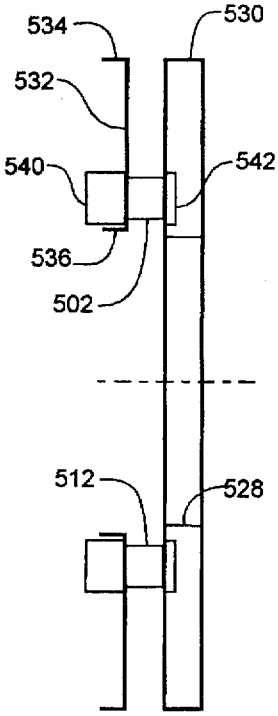
Figure 9:
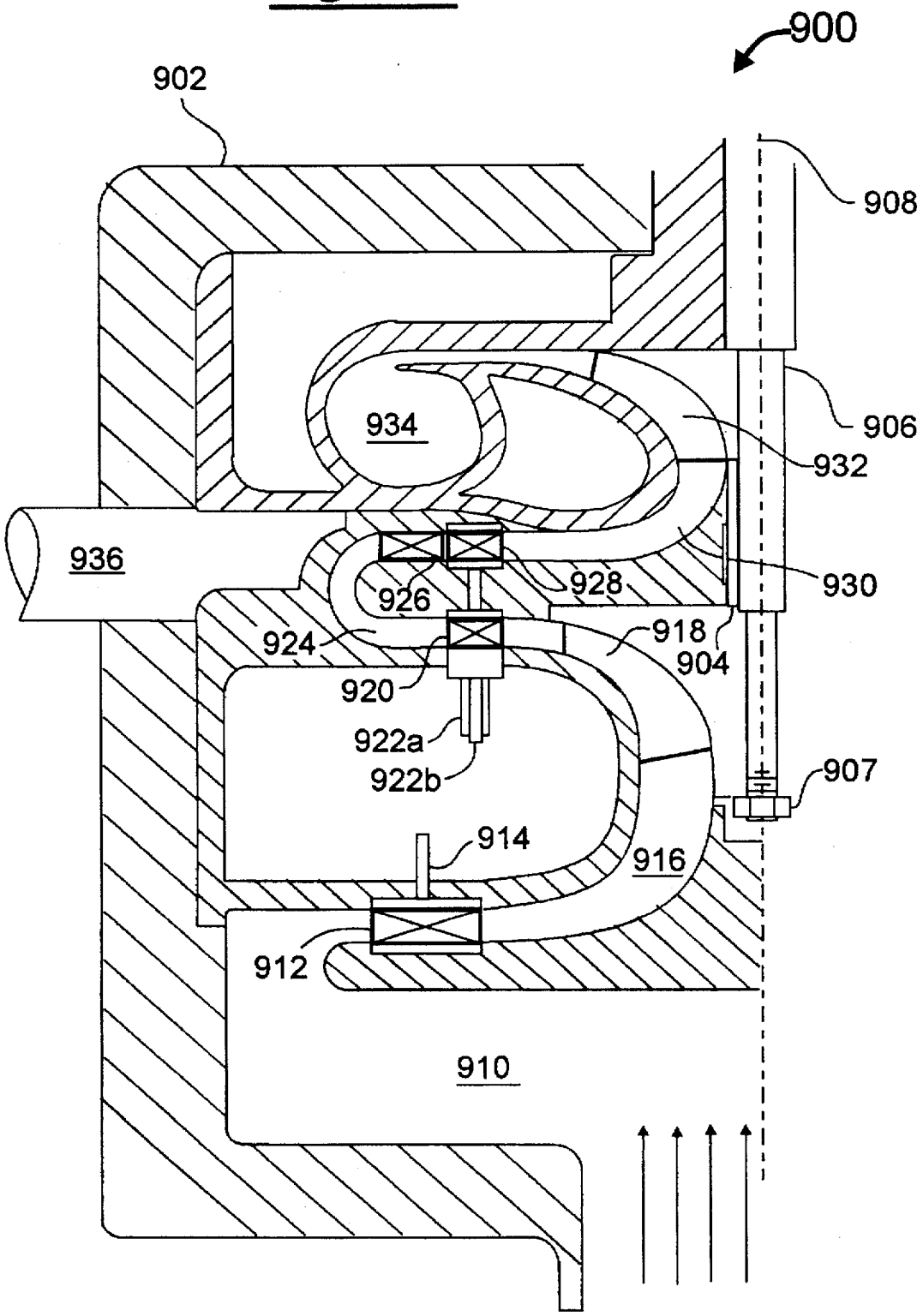
FIG. 9 is a cross-sectional view of a multistage centrifugal compressor, according to an embodiment of the present invention.

FIGS. 5A and 5B illustrate an exemplary diffuser system 500, similar in many respects to the low solidity airfoil diffuser disclosed in the aforementioned CETI patent (see, e.g., FIG. 9 therein). The diffuser operates immediately downstream of a centrifugal compressor (or pump) impeller (not shown). The flow leaves the impeller and passes through the diffuser cascade and subsequently out through a vaneless diffuser (not shown).

Extensive flowfield traversing has established that an airfoil cascade provides some good diffusion in the classical sense of lift, but also stabilizes and organizes the very complex flow leaving the impeller such that the subsequent vaneless diffuser can work at its best efficiency. The cascade diffuser design is generally superior overall, in terms of pressure ratio, efficiency and range, as compared with high performance channel diffusers and tandem airfoil diffusers. The cascade diffuser has been a useful commercial product in several applications. There are variations in the particular design parameters which lead to optimum configurations, including the specific location, solidity, and shape of the vanes, etc.

The diffuser system 500 of FIGS. 5A and 5B comprises a plurality (twelve shown) of vanes 502 . . . 524 mounted to a surface of a rear wall 526. The rear wall 526 is generally planar, a ring-like platform having an inner edge (radius) 528 which corresponds to the impeller (not shown, see, e.g., CETI patent, FIG. 9, element 14) exit radius, and an outer edge (radius) 530 which is the diffuser exit radius.

The vanes 502 . . . 524 comprise a "set of vanes", each disposed at a position equidistant from a center (labelled 550), and preferably spaced apart from each other at regular intervals. The vane set is a circular row of vanes (or blades).

In the CETI patent, the vanes (labelled 18 therein, corresponding to 502 . . . 524 herein) are set to a design point angle of attack corresponding to the classic onset of pressure side stall of the airfoil vanes, and are not movable.

According to the present invention, at least a portion of the vanes 502 . . . 524 are movable (positionable, with respect to angle of attack, or angle of incidence, with respect to flow).

The vane elements 502 . . . 524 are mounted between the outer wall 526 and an inner wall 532. Further, each vane is supported between a pedestal 542 on the outer wall 526 and a pedestal 540 on the inner wall 532, so that the vane is "captured" between two disks or pedestals on each side, thus permitting negligible leakage both above and below the vane. (It is, however, within the scope of this invention that one of the two pedestals can be omitted, such as for cost savings, if desired.) Furthermore, the cross-sectional area (e.g., diameter) of the pedestal is preferably very large (i.e., at least a significant fraction of, such as 0.25 to 1.25) as compared with the overall chord length of the vane. (Generally, the maximum diameter of the pedestal is "mechanically" constrained by adjacent pedestals.) This forms an ideal situation for variable geometry devices, when rotation of the vane is required. Excellent torque can be delivered to the vane. Additionally, the substantial pedestal size provides good freedom to the designer for support and for sealing.

Figure 4:
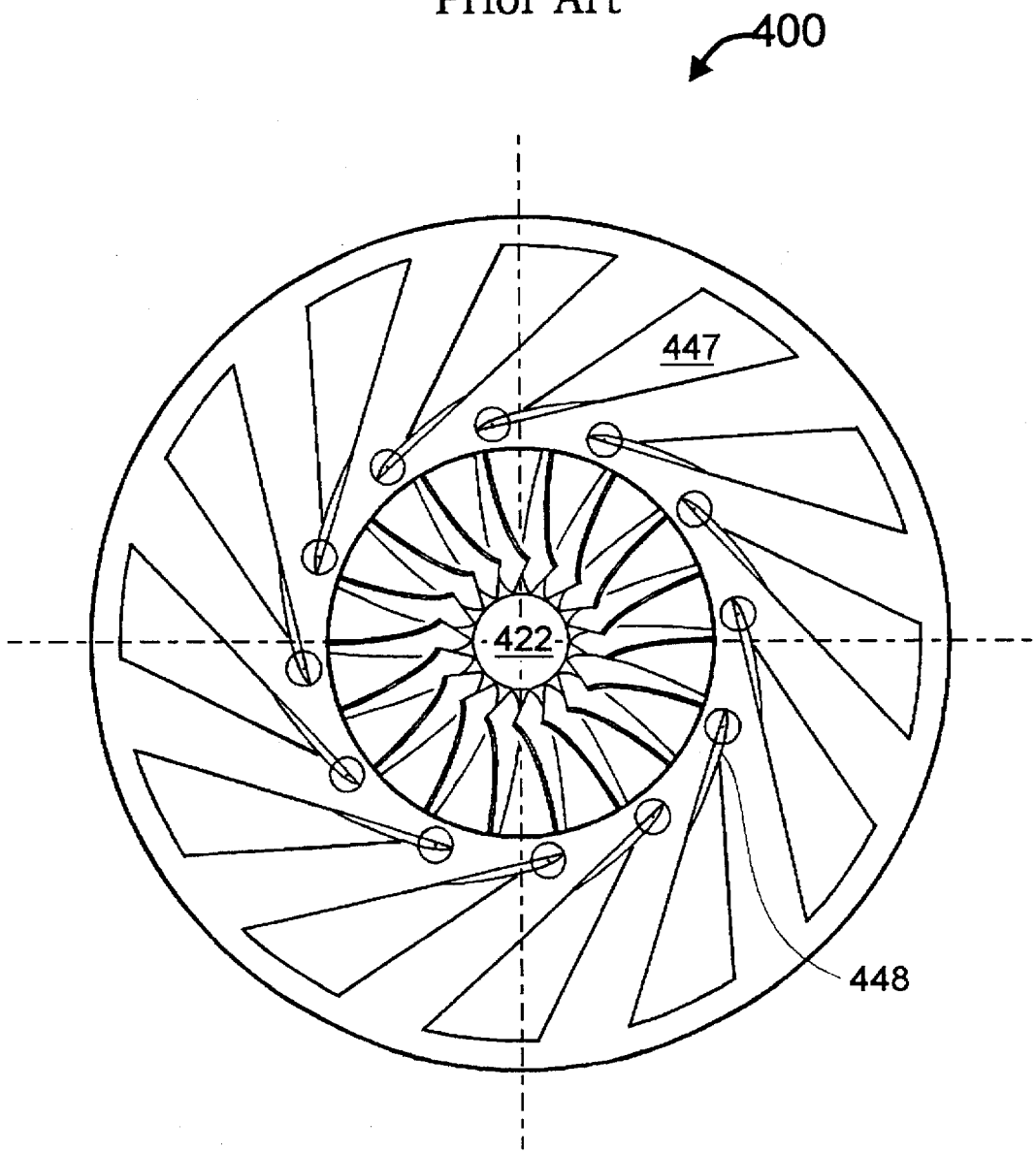
Figure 4 Prior Art
FIG. 4 is a front view of a diffuser assembly, such as is disclosed in the BLACKBURN patent (prior art).

The cascade diffuser 500 illustrated in FIG. 5 is well suited to the floating, BLACKBURN-type vane concept shown in FIG. 4 which uses a floating vane (48) which is constrained at high flow levels so that it locks up against the subsequent downstream vane island element. In this case, no limitation is placed by any device in the flow stream itself. If limitations to the angular motion of any vane are desired, they can be implemented by position control elements (not shown) in the pedestal region, outside of the flowfield. Consequently, this embodiment 500 provides for completely free-floating operation, and not the partial floating disclosed in the BLACKBURN patent. Likewise, the embodiment requires no downstream element, and stands totally on its own.

Figure 6A:
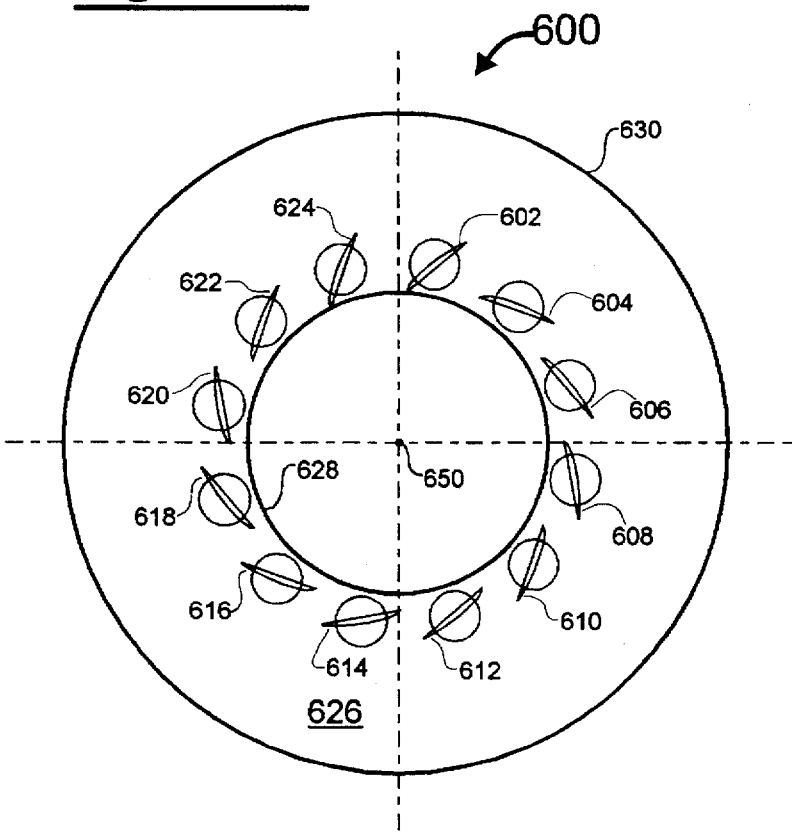
FIGS. 6A and 6B are front and side views, respectively, of a diffuser system, illustrating free-floating "normal" vanes, and fixed or scheduled "rogue" vanes, according to an embodiment of the present invention.
Figure 6B:
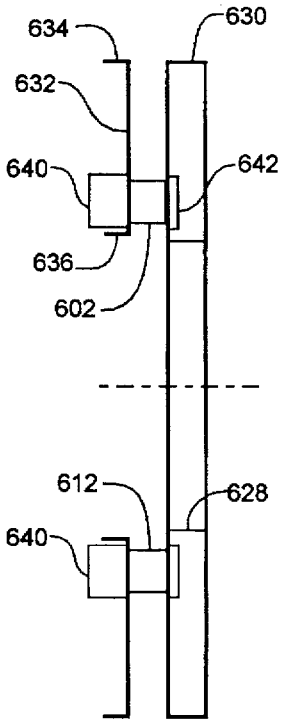

FIG. 6 illustrates another embodiment 600 of the invention. As in the previous embodiment 500, twelve vanes 602 . . . 624 are arranged in a vane set in a diffuser. In this embodiment, two of the twelve vanes in the vane set are "rogue" vanes, which are employed to dominate flow control (i.e., the rogue vanes are set for higher flow). For example, the vanes 602 and 624 are "rogue" vanes. The remaining ("normal") vanes 604 . . . 622 are free-floating vanes, for low flow. Alternatively, the remaining vanes can be controlled-position (positionable) vanes.

As a general proposition, vanes such as diffuser vanes can be airfoil-shaped, or can simply be flat plate-shaped elements. Moreover, the vanes can be (i) "fixed" (i.e., immovable) at a certain position, (ii) "free-floating", or (iii) "positionable" (including "scheduled" and "controlled") over a range of positions in response to flow or other operating parameters and, optionally as positioned by an actuator mechanism. It is within the scope of this invention that the rogue vanes are airfoil-shaped, flat plate-shaped elements, fixed, free-floating, or positionable. Generally, as discussed in greater detail hereinbelow, free-floating rogue vanes are preferably restrained.

As in the previous embodiment (500) the vanes 602 . . . 624 are mounted between an inner wall 632 (compare 532) and an outer wall 626 (compare 526), and are mounted to respective pedestals 640 (compare 540) and 642 (compare 542). The outer wall 626 has a center 650 (compare 550), an inner radius 628 (compare 528) and an outer radius 630 (compare 530).

The principle of a portion of the vanes in a vane set being "rogue" vanes (602 and 624) begins to introduce the possibility of employing a degree of partial emission or admission behavior. Many geometric configurations are possible. FIG. 6 illustrates a straightforward case where one or two rogue vanes (two, 602 and 624, are shown) are maintained at a nominal, typical design point operating condition, and all of the remaining vanes (604 . . . 622) are permitted to float down to more nearly closed positions typical of low-flow operation. This configuration can be reached by:

(a) permanently fixing the rogue vanes (602 and 624) at the design point position;

(b) switching (scheduling) the rogue vanes (602 and 624) to the design point position, or at another preferred operating condition, at some desired point of operation (i.e., based on a sensed low flow rate); or (c) allowing all of the vanes (rogue and normal) to float freely, but restraining movement of the rogue vanes so that the maximum degree of closing is limited to a predetermined level. At low flow rates, the rogue vanes would be more open than the remaining (normal) vanes. In such a case, it is preferred that the rogue vanes are "partially free-floating", being limited in their range of movement only by a fixed minimum position to which the rogue vanes could (otherwise) close.

In any of these cases, the remaining vanes (604 . . . 622) can be allowed to free-float, or can be mechanically positioned (without free-floating) into the desired position.

Figure 1:
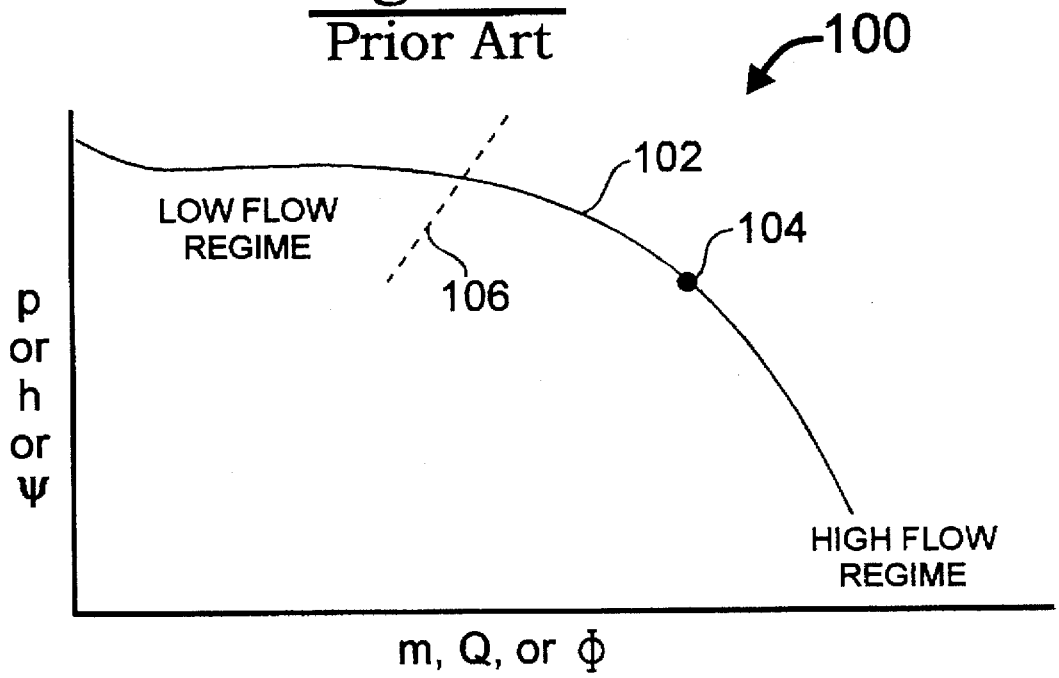
Figure 1 Prior Art
FIG. 1 is a diagram showing a generalized plot of pressure rise (vertical axis) versus mass flow rate (horizontal axis), according to the prior art.
Figure 7:
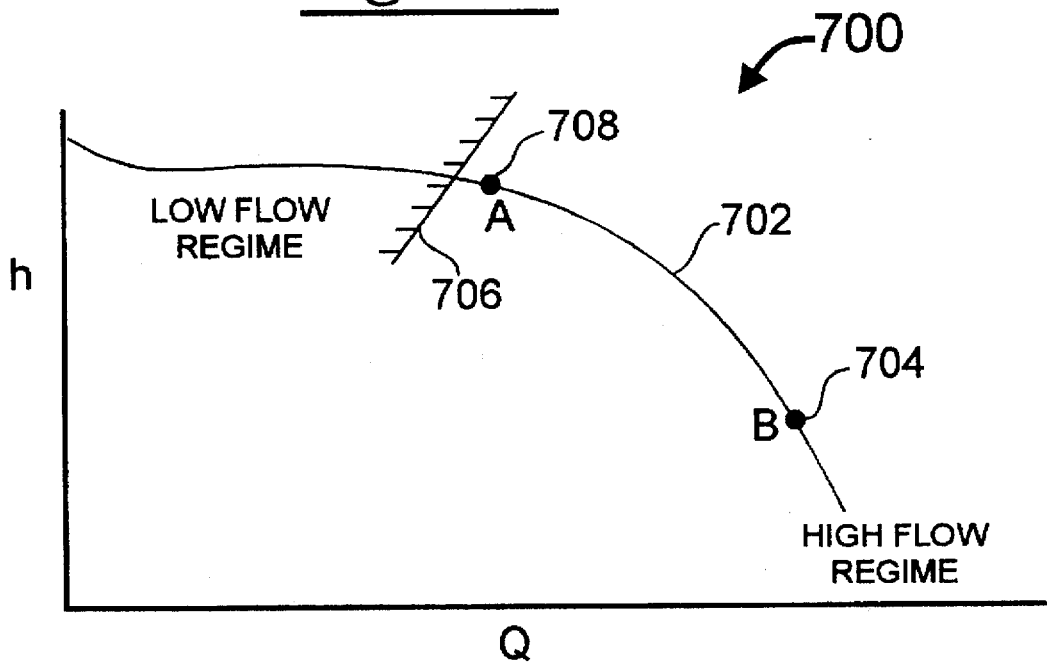
FIG. 7 is a diagram showing a generalized plot of pressure rise (vertical axis) versus mass flow rate (horizontal axis), according to the present invention.
Figure 2A:
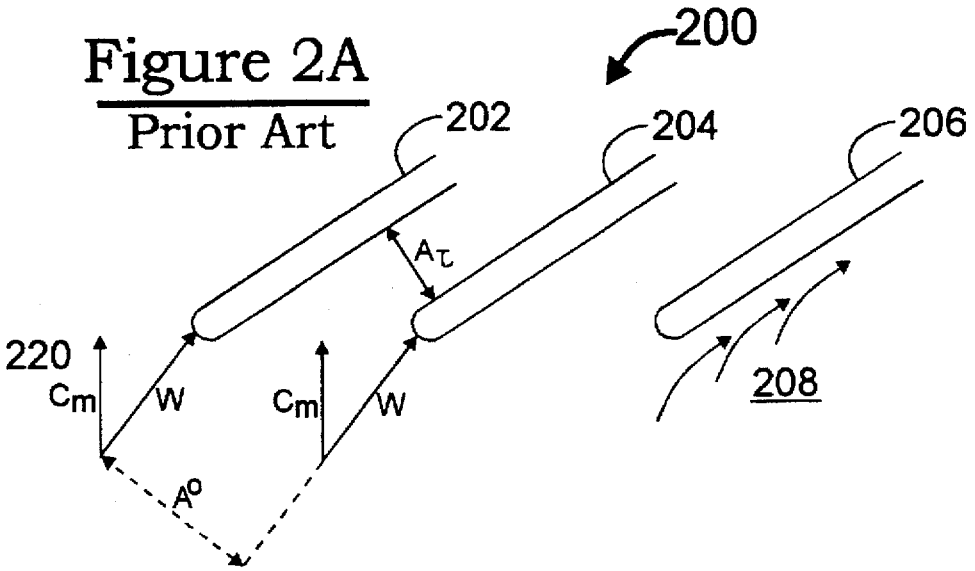
Figure 2A Prior Art
FIGS. 2A–2C are schematic illustrations of flow into blades (vanes) of a blade row, at various flow levels, showing velocity triangles associated therewith, according to the prior art.
Figure 2B:
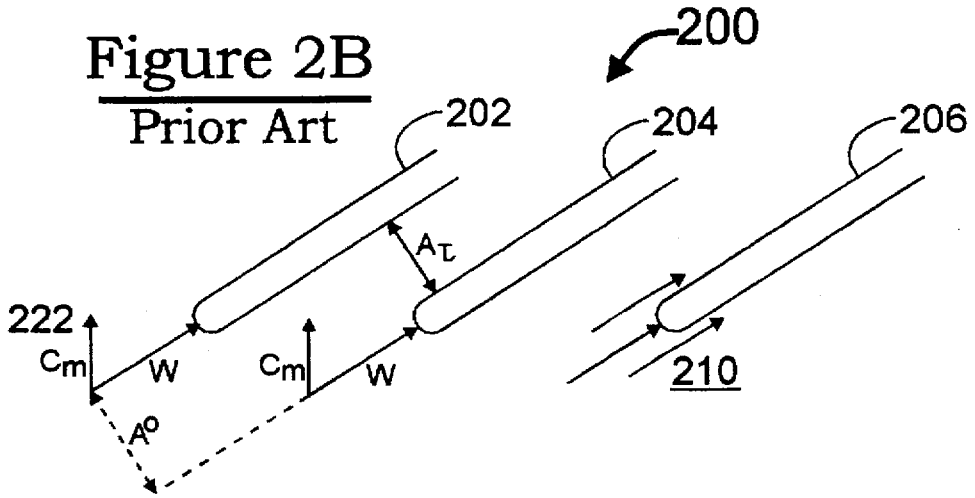
Figure 2B Prior Art
Figure 2C:
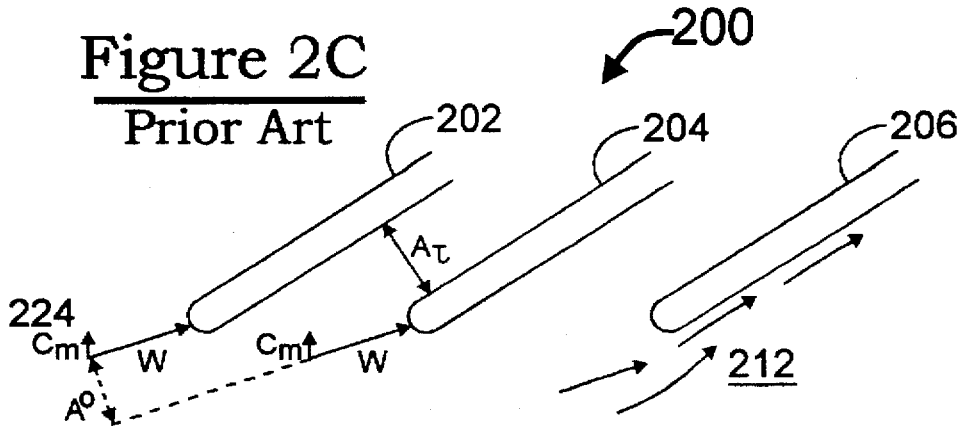
Figure 2C Prior Art
Figure 2D:
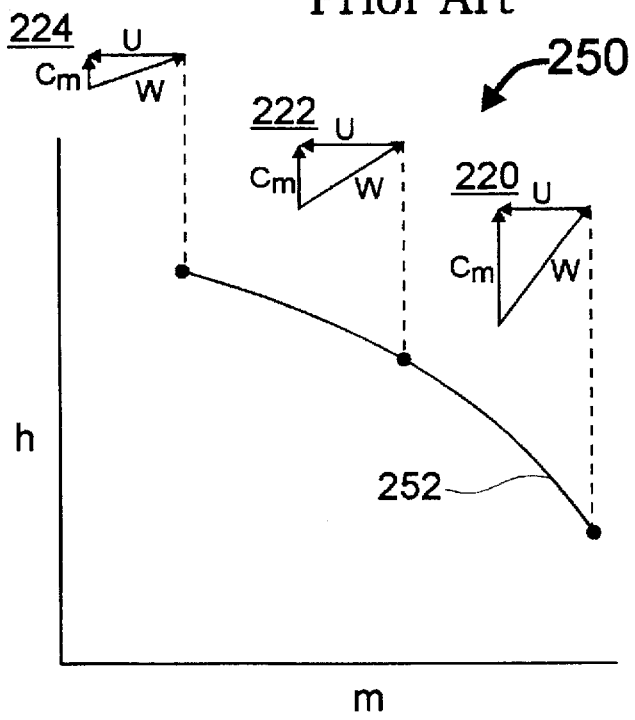
Figure 2D Prior Art
FIG. 2D is schematic illustration of the relationship between velocity triangles of FIGS. 2A–2C to a plot of pressure rise (h) versus mass flow rate (m), according to the prior art.
Figure 3:
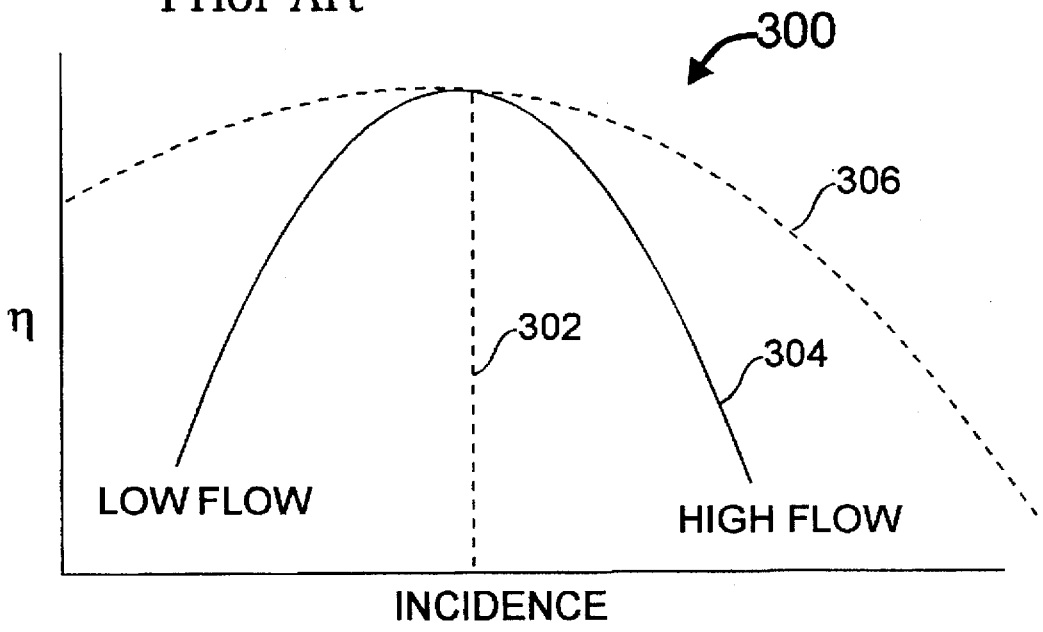
Figure 3 Prior Art
FIG. 3 is plot of efficiency "η", at a given speed, versus incidence onto an impeller (or onto other blades rows), according to the prior art.

One possibility is to leave all of the vanes (i.e., rogue and normal) in a very open position, which would result in operation proceeding from a Point B (704) to a Point A (708) shown on the curve 702 of FIG. 7. When approaching Point A, it is clear that a stability limit (e.g., 706 (compare 106, FIG. 1) has been approached, at which point it is possible to switch the vanes (e.g., 604 . . . 622) to a second position of a more closed location, except for the rogue vanes (e.g., 602 and 624). The rogue vanes will permit a large amount of flow to pass through their region of the passage, with less flow in the circumferential adjacent vane passages.

According to an aspect of the invention, any number of rogue vanes may be employed, some of which are located on one side of the diffuser, and others of which are located on the opposite (circumferentially opposed) side of the diffuser, in order to balance radial thrust force across the impeller, if desired.

In the embodiments described hereinabove, the rogue vanes are generally set to a different angle of attack than the remaining vanes in the vane set, dominating flow and permitting operation in regions that would otherwise signal incipient surge or stall. It is evident that the flow characteristics will abruptly differ, as a result of the rogue vanes being set at a different angle of attack than the remaining vanes. Although such an abrupt transition is not necessarily "bad", according to an aspect of the invention, a less abrupt transition may be implemented by allowing vanes immediately adjacent the rogue vanes to free-float, alternatively to be set (positioned), to intermediate positions (i.e., intermediate the position of the rogue vanes and the remaining vanes).

Figure 8A:
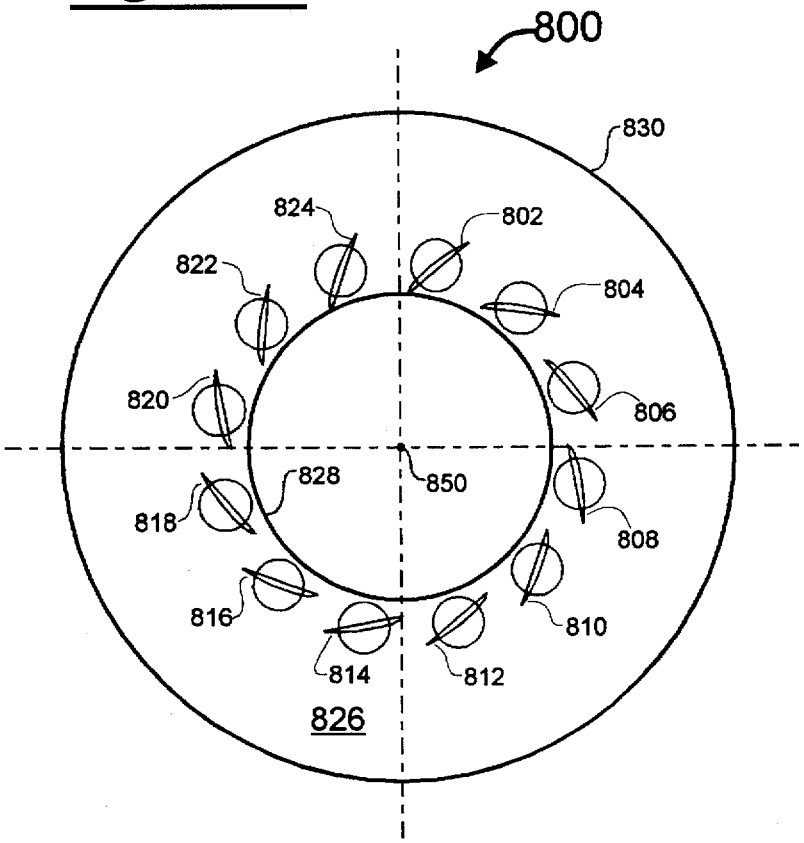
FIGS. 8A and 8B are front and side views, respectively, of a diffuser system, illustrating free-floating "normal" vanes, and fixed or scheduled "rogue" vanes, plus "intermediate" vanes, according to an embodiment of the present invention.
Figure 8B:
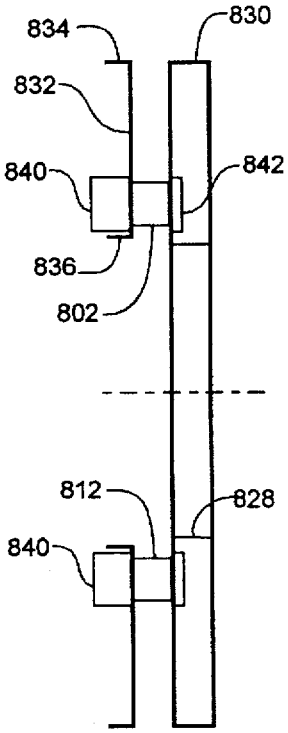

FIG. 8 shows an embodiment 800 of a diffuser section having two rogue vanes 802 and 824, adjacent one another and establishing a "sector" of rogue vanes. Two "intermediate" vanes 804 and 822 are disposed immediately adjacent the rogue vane sector (802, 824), and between the rogue vanes and the remaining vanes 806 . . . 820. For purposes of this discussion, the remaining (eight) vanes 806 . . . 820 are the "normal" vanes.

The normal vanes are illustrated as having been moved to a nearly closed position. The rogue vanes 802 and 824 are illustrated as being left at their design position. The intermediate vanes 804 and 822 are set at angles which facilitate smooth transition from the rogue vanes to the normal vanes.

It is within the scope of this invention that any schedule can be used for any of these vanes (i.e., rogue, intermediate, or normal) to create a channelized flow to enhance performance and to reduce vibratory disturbance.

As in the previous embodiment (600) the vanes 802 . . . 824 are mounted between an inner wall 832 (compare 632) and an outer wall 826 (compare 626), and are mounted to respective pedestals 840 (compare 640) and 842 (compare 642). The outer wall 826 has a center 850 (compare 650), an inner radius 828 (compare 628) and an outer radius 830 (compare 630).

The concept of using rogue vanes permits one or more vanes in a vane set to be intentionally positioned differently from the remaining vanes, thereby permitting the possibility of scheduling any one of the set of vanes, whether rogue or "normal", to any desired schedule, and permits the possibility of any vane being free-floating.

For example, the rogue vanes can be allowed to free-float to an open position, while the remaining vanes are closed by a servo-controlled device (not shown). In this manner, a portion of the vanes can be employed to throttle the flow down (i.e., partial admission or partial emission), and the free-floating rogue vanes could be allowed to find their own optimum position while achieving the desired partial admission characteristic.

According to a feature of the invention, buttons or pedestals may be used on each side of the vane in order to control sealing, and to provide suitable bearing surfaces. Additionally, the use of platforms on either side of the flow path permits the possibility of passing through-bolts (not shown) through the system in order to obtain structural integrity of the overall pump or compressor system, if desired.

Additionally, this affords the possibility of passing a control rod through a first row, and delivering the control rod to a suitable position of a second row, such as may be found on a two-stage refrigeration compressor or other similar turbomachine.

FIG. 9 illustrates major functional elements of a two stage compressor 900. The compressor comprises a housing 902, within which are several rotating components (discussed hereinbelow), and including various insert pieces (not numbered, shown as cross-hatched).

The rotating components include a first stage rotor 918 and a second stage rotor 932, a spacer 904, a shaft 906, and an attachment nut 907.

The housing 902 includes an inlet plenum 910. Air (or any suitable fluid), enters the plenum 910, as indicated by the arrows, and passes a row (set) of inlet vanes 912. The positions (angles of incidence) of these inlet vanes 912 is controlled by a suitable mechanism (not shown), via a control rod 914. The function of the vanes 912 is to regulate the inlet flow state.

The fluid (e.g., air) is then directed through an intermediate passageway 916 and is compressed (or pumped) by a set of impeller vanes 918.

The fluid next passes a first row (set) of outlet diffuser vanes 920, the positions of which are controlled by a suitable mechanism (not shown) via a control rod 922*a* (outer). The function of the vanes 920 is to permit controlled diffusion of the rotor exit flow.

The fluid next passes through a passageway 924, then passes through a row of deswirl vanes 926, the function of which is to remove tangential kinetic energy from the flow.

The fluid next passes through a second row (set) of outlet (diffuser) vanes 928 which is disposed axially above (as shown) the first row of outlet vanes 920, on a common centerline. The control rod 922*b* (inner) is concentric and within the control rod 922*a*, and controls the positions of the outlet vanes 928 either independently of or in common with the positions of the outlet vanes 920. It is within the scope of this invention that the outlet vanes are controlled in common with the outlet vanes 920, by a single (rather than concentric) control rod. The function of the vanes 928 is similar to the vanes 912, and the vanes 928 control the inlet flow state to the second stage impeller (932).

The fluid next flows through a passageway 930 and, after passing a set of rotor vanes 932, exits the compressor 900 at an outlet element 934.

A duct 936 is illustrated, which is an optional entry or exit duct for side stream flow, to permit more (or less) flow in the second stage.

The possibility of using free-floating vanes, rogue vanes, and partially or totally scheduled vanes, affords fluid dynamic performance advantages, as well as vibration and acoustic advantages. It is within the scope of this invention that the rogue vane concept may be employed on any or all of the blade rows 912, 920, 926, 928, or other similar rows (not shown).

It is known that the flowfield leaving a centrifugal compressor or pump has highly fluctuating velocity vectors, strong velocity and total pressure gradients, as well as strong gradients in vorticity and in turbulence. The flow passing through the airfoil cascade diffuser shown in FIG. 5 substantially reduces these variations. By allowing the elements (vanes) to freely float, or to use a combination of floating and scheduled orientation, conditions can be created whereby vibration levels are mitigated and acoustic propagation reduced. Because of the comparatively large pedestal size, and rather small arc of rotation required for each vane (i.e., within a range of a few degrees), good mechanical integrity can be developed for these vanes, and practical flow control can be introduced.

The condition of well-mounted vanes, such as is shown in FIG. 5 (see, e.g., pedestals 540 and 542), affords the possibility to provide interesting and unique dynamic control over the response of each vane. Although these vanes (e.g., 502 . . . 524) can be configured to be free-floating, the individual stiffness and damping of each vane can independently be set. Consequently, using appropriate schedules of stiffness and damping, it is possible to permit the vanes to respond to changing flow conditions in a gradual or progressive (i.e., rather than in an abrupt) manner.

For example, if the flow rate is changed, the vanes having the least damping or stiffness will be adapt quickly to the changed flow conditions, and those vanes having greater stiffness or damping will respond more gradually. In this manner, a progressive state of conditions can be introduced which allows the flow to respond with less severe alteration. With proper scheduling, this can have an influence on any mode of dynamic instability.

As noted hereinabove, compressor and pump reaction is usually greater than the reaction (near zero, i.e., impulse) of partial admission turbines. Greater backflow in the "dead" zones may result. It is this fundamental difference in reaction which, it is believed, has led previous investigators to ignore the possibility of the rogue vane concept and the channelized flow, with its positive benefits. The possible rotor backflow through the "dead" zones may be reduced by close-coupling of rotor and diffuser, and other means. A significant advantage of the present invention accrues in the context of close-coupling of stator vanes (for example, the cascade diffuser shown in FIG. 5) with respect to the rotor, and by the use of conventional backflow control devices.

Figure 10:
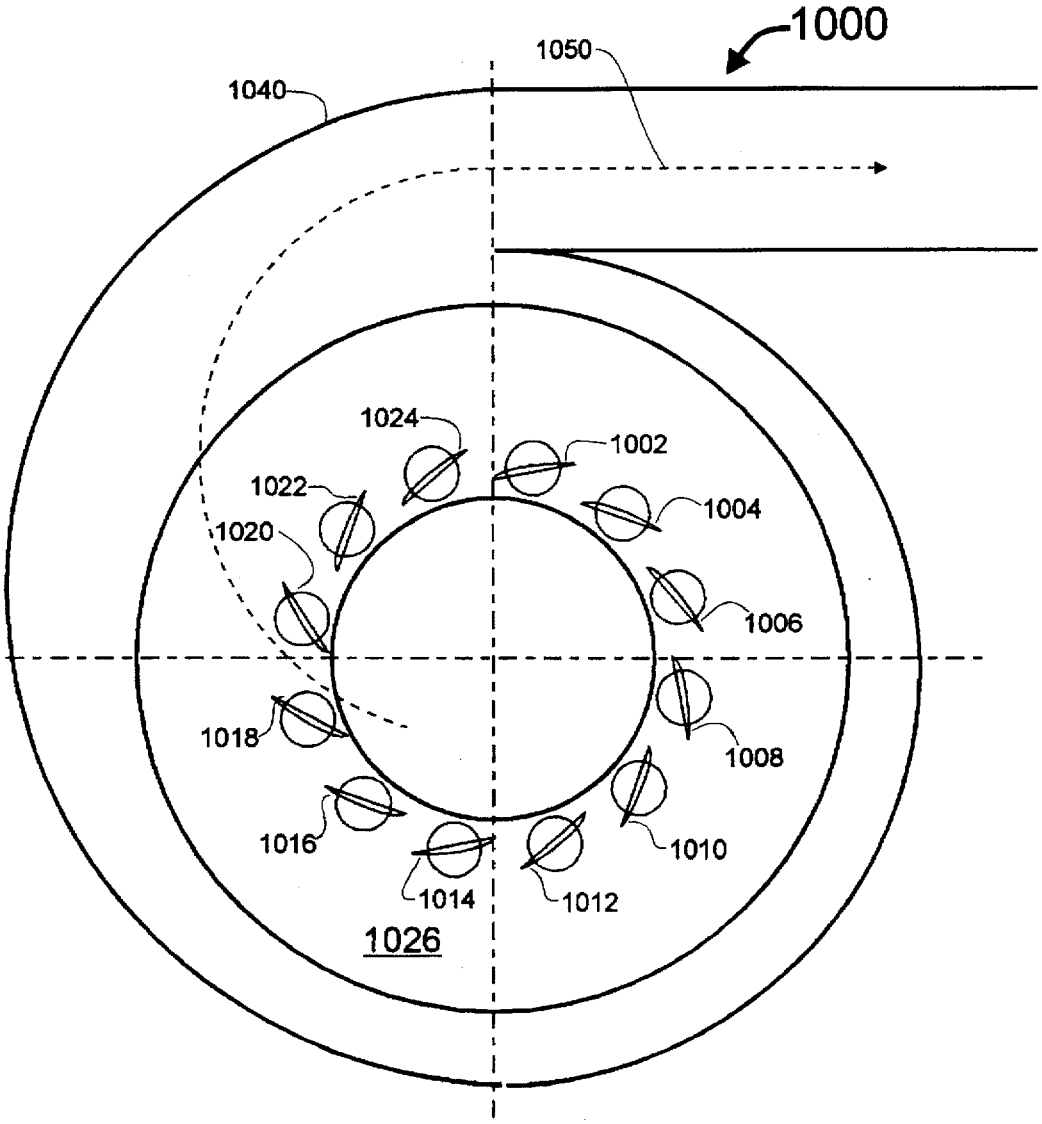
FIG. 10 is a front view of an exemplary alignment of rogue vanes, in the case of a centrifugal pump or compressor, using a volute, according to the present invention.

FIG. 10 illustrates an exemplary particular alignment of rogue vanes 1018 and 1020, in the case of a centrifugal pump or compressor 1000, and shows a cascade 1026 (compare 526, 626, 826) with a surrounding volute 1040. The remaining vanes are labelled 1002 . . . 1016, 1022 and 1024. In this example, the rogue vanes 1018 and 1020 are located at a position such that the preponderance of the flow will proceed through the impeller (not shown), subsequently through the rogue vanes 1018 and 1020 (as indicated by the dashed line 1050), and then smoothly into the volute 1040. If the rogue vanes were located immediately under the cutwater (i.e., if the vanes 1002 and 1024 were the rogue vanes for example), the flow would have to follow a very long path through the volute with substantial frictional losses. However, by placing the rogue vanes in an optimum position, approximately as shown in FIG. 10, the flow (1050) will pass smoothly through the system with minimum frictional effects and maximum pressure recovery. It is within the scope of this invention that the vanes 1006 and 1008 might also be operated (i.e., more open) as rogue vanes to effect a radial thrust balance, if desired.

FIGS. 11A–11D illustrate an implementation of rogue vanes for an axial compressor 1100. A compressor section 1100 has interleaved rotor blades ( labelled "R") and stator vanes (labelled "S"). (Generally, rotor elements are typically referred to as "blades", and stator elements are often referred to as "vanes", though these terms are sometimes mixed, in common usage.)

Figure 11A:
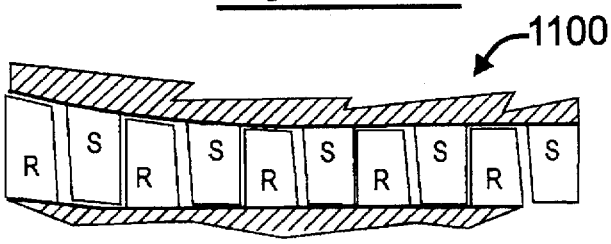
FIG. 11A is a partial sectional view of an axial compressor, having a rotor (R) and a stator (S)—the stator incorporating rogue vanes, according to the present invention.
Figure 11B:
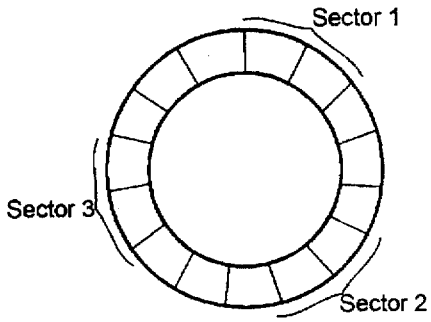
FIG. 11B is a schematic of sectors of the stator of the compressor of FIG. 11A, according to the present invention.

As best viewed in FIG. 11B, three sectors (labelled Sector 1, Sector 2, and Sector 3) of rogue vanes are utilized, in the set of stator vanes (S). As flow is reduced, the free-floating or scheduled vanes (remaining, non-rogue stator vanes) will close down, forcing the flow through the passages established by the rogue vanes which remain unstalled. The free-floating or scheduled remaining vanes may or may not have some degree of stall. The average performance of such a machine is improved at partial load conditions since the vast majority of flow is passing through the sectors dominated by the rogue vanes, and these are operating at or near their best efficiency point. Rotating stall is partially or totally blocked. Hence, stability conditions are significantly improved.

In this embodiment, employing three sectors of rogue vanes may be preferred in order to keep radial forces balanced reasonably around the circumference of the compressor. However, it is within the scope of this invention that a single sector can be used, and such approaches may well be preferably with regard to efficiency as used for partial admission steam turbines. The single sector approach can also be preferably from a standpoint of vibratory frequency. Any stator vane row or any radial or axial or mixed flow turbomachine can be provided with rogue vanes to create a preferred channel of flow with enhanced performance. For rotors located between stator rows, the proper phasing of rogue vanes provides a channel or path of flow between the two stator rows, which will also control rotating stall in the rotor blade row. The latter will normally not be fitted with rogue vanes, due to mechanical complexity.

Figure 11C:
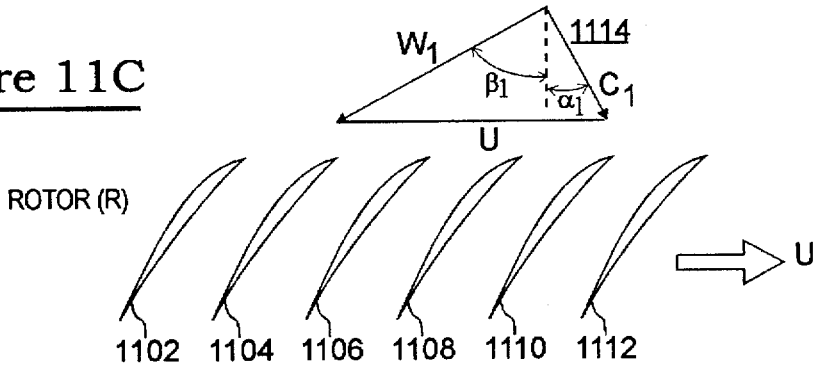
FIGS. 11C and 11D are illustrations of flow parameters (including velocity triangles) for the rotor and stator, respectively, of the compressor of FIG. 11A, according to the present invention.

FIG. 11C illustrates a portion of the blades 1102 . . . 1112 of the rotor. These blades are labelled "R" in FIG. 11A.

An exemplary velocity triangle 1114 for these rotor blades is shown in the FIG. 11C. An angle $\beta_1$ is formed between the $W_1$ vector and the dashed line, and is indicative of the relative flow angle of the approaching (incoming) flow. An angle $\alpha_1$ is formed between the $C_1$ vector and the dashed line, and is indicative of the approach absolute flow direction.

Figure 11D:
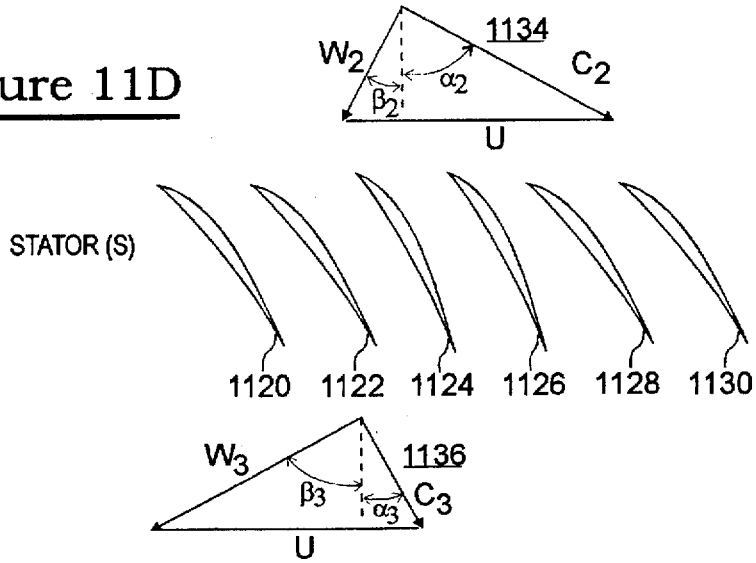

FIG. 11D illustrates a portion of the vanes 1120 . . . 1130 of the stator, two of which are rogue vanes 1124 and 1126. These vanes are labelled "S" in FIG. 11A.

An exemplary velocity triangle 1134 for the rogue vanes 1126 and 1128 is shown in the FIG. 11D. An angle $\beta_2$ is formed between the $W_2$ vector and the dashed line, and is indicative of the rotor exit relative flow direction. An angle $\alpha_2$ is formed between the $C_2$ vector and the dashed line, and is indicative of the stator inlet absolute flow direction. The angle $\beta_2$ is approximately (roughly) equal to the angle $\alpha_1$, and the angle $\alpha_2$ is approximately equal to the angle $\beta_1$.

An exemplary velocity triangle 1136 for the stator vanes is shown in the FIG. 11D. An angle $\alpha_3$ between the $C_3$ vector and the dashed line is less than the angle $\alpha_2$, and approximately equals the angle $\beta_2$. This is indicative of the stator vane exit flow direction.

Although the invention has been illustrated and described in detail in the drawings and foregoing description, the same is to be considered as illustrative and not restrictive in character—it being understood that only preferred embodiments have been shown and described, and that all changes and modifications that come within the spirit of the invention are desired to be protected.

For example, although the pedestals are illustrated (e.g., in FIG. 6) as being generally concentric with the vanes, it is within the scope of this invention that the pedestals could be located more towards the leading edges of the vanes, including extending beyond the leading edges of the vanes.

What is claimed is:

1. Turbomachine, comprising:

a vane set including a plurality of vanes disposed in a circular row, a first portion of the vanes being rogue vanes, a second portion of the vanes being normal vanes;

wherein:

for a given flow through the vane set, the angle of incidence of the rogue vanes differs from the angle of incidence of the normal vanes.

2. Turbomachine, according to claim 1, wherein:

the first portion of vanes includes at least one rogue vane.

3. Turbomachine, according to claim 1, wherein:

the rogue vanes establish a channelized flow through the vane set and through adjacent rotor blading.

4. Turbomachine, according to claim 1, wherein:

the rogue vanes are set to dominate flow through the vane set relative to the normal vanes.

5. Turbomachine, according to claim 1, wherein:

the rogue vanes are set for higher flow than the normal vanes.

6. Turbomachine, according to claim 1, wherein:

the turbomachine is a radial flow turbomachine.

7. Turbomachine, according to claim 1, wherein:

the turbomachine is an axial flow turbomachine.

8. Turbomachine, according to claim 1, wherein:

the rogue vanes control operating characteristics of the turbomachine under conditions of reduced flow.

9. Turbomachine, according to claim 1, wherein:

the rogue vanes control operating characteristics of the turbomachine under conditions of partial admission.

10. Turbomachine, according to claim 1, wherein:

the rogue vanes control operating characteristics of the turbomachine under conditions of partial emission.

11. Turbomachine, according to claim 1, wherein:

the vane set is disposed between two walls.

12. Turbomachine, according to claim 11, further comprising:

pedestals, to which the vanes are mounted.

13. Turbomachine, according to claim 12, wherein:

each vane has an overall chord length;

each pedestal has a diameter; and the diameter of the pedestal is between 0.25 and 1.25 times the overall chord length of the vane.

14. Turbomachine, according to claim 1, wherein:

the rogue vanes are arranged in sectors.

15. Turbomachine, according to claim 1, wherein:

the rogue vanes are arranged in sectors; and the sectors are arranged to balance forces imposed by the vane set.

16. Turbomachine, according to claim 1, wherein:

the rogue vanes are permanently fixed at a design point position.

17. Turbomachine, according to claim 16, wherein:

the normal vanes are free-floating.

18. Turbomachine, according to claim 1, wherein:

all normal vanes are free-floating; and the rogue vanes are partially free-floating.

19. Turbomachine, according to claim 1, further comprising:

means for scheduling the rogue vanes to a design point position.

20. Turbomachine, according to claim 19, wherein:

the normal vanes are scheduled.

21. Turbomachine, according to claim 1, wherein:

the normal vanes are free-floating.

22. Turbomachine, according to claim 1, wherein:

the normal vanes are scheduled.

23. Turbomachine, according to claim 1, further comprising:

a third portion of the vanes being intermediate vanes;

wherein:

for the given flow through the vane set, the angle of incidence of the intermediate vanes is between the angle of incidence of the rogue vanes and the angle of incidence of the normal vanes.

24. Turbomachine, according to claim 1, wherein:

the vane set is a diffuser, and is disposed in a volute.

25. Turbomachine, according to claim 24, wherein:

the rogue vanes are located in proximity to the volute and distant from a cutwater.

26. Turbomachine, according to claim 24, wherein:

the rogue vanes are positioned away from a cutwater of the turbomachine.

27. Turbomachine, according to claim 24, wherein:

the turbomachine is a pump.

28. Turbomachine, according to claim 24, wherein:

the turbomachine is a compressor.

29. Turbomachine, according to claim 1, wherein:

all of the vanes are set in an open position at high flow rates;

the normal vanes are set to a more closed position at low flow rates; and the rogue vanes are left in an open position at the low flow rates.

30. Turbomachine, according to claim 1, wherein:

the turbomachine is an axial compressor, including single stage and multi-stage axial compressors.

31. Turbomachine, according to claim 1, wherein:

the turbomachine is a hydraulic pump-turbine.

* * * * *